US006308451B1

(12) United States Patent
Koledey

(10) Patent No.: US 6,308,451 B1
(45) Date of Patent: Oct. 30, 2001

(54) LOADER FOR REVOLVER

(75) Inventor: William E. Koledey, Olmstead Falls, OH (US)

(73) Assignee: William E. Kolodey, Olmstead Falls ( * ) Notice: Subject to any disclaimer, the term of this patent is extended or adjusted under 35 U.S.C. 154(b) by 0 days.

(21) Appl. No.: 09/491,889

(22) Filed: Jan. 24, 2000

(51) Int. Cl.[7] ..... F41A 9/61
(52) U.S. Cl. ..... 42/89; 42/89
(58) Field of Search ..... 42/89

(56) References Cited

U.S. PATENT DOCUMENTS

| | | | | |
|---|---|---|---|---|
| 1,480,812 | * | 1/1924 | Bazan | 42/89 |
| 3,503,150 | * | 3/1970 | Brunhuber et al. | 42/89 |
| 3,541,716 | * | 11/1970 | Fordham et al. | 42/89 |
| 3,722,125 | | 3/1973 | Switzer | 42/89 |
| 4,202,124 | | 5/1980 | Switzer | 42/89 |
| 4,229,896 | | 10/1980 | Jurich, III | 42/89 |
| 4,313,275 | | 2/1982 | Switzer | 42/89 |
| 4,697,368 | | 10/1987 | Williams | 42/71.02 |
| 4,697,369 | | 10/1987 | Spears | 42/89 |
| 4,702,170 | | 10/1987 | Trudeau | 102/446 |
| 5,842,299 | * | 12/1998 | Switzer et al. | 42/89 |
| 5,953,845 | * | 9/1999 | Longwitz | 42/89 |

FOREIGN PATENT DOCUMENTS

566757 * 1/1945 (GB) .

* cited by examiner

*Primary Examiner*—Michael J. Carone
*Assistant Examiner*—Lolit Semunegus
(74) *Attorney, Agent, or Firm*—Emerson & Skeriotis; John M. Skeriotis

(57) ABSTRACT

An improved cartridge loader for releasable securement of cartridges to be simultaneously loaded into the cylinder of a revolver. A pintle rotates between a cartridge engaging position and a cartridge releasing position and is held in positive engagement with the loader body by the action of a spring-loaded pin assembly along a pin-engaging surface. The pin-engaging surface may be formed in the pintle and the pin assembly is substantially located within the loader body.

8 Claims, 5 Drawing Sheets

LOADER FOR REVOLVER

BACKGROUND OF THE INVENTION

I. Field of the Invention

This invention relates to improvements in cartridge holders and is particularly directed to cartridge holders adapted to releasably secure a round of cartridges for fast and simultaneously loading of the round into the chambers and the cylinders of revolvers.

II. Description of the Related Art

It is well known in the art to utilize a cartridge loader in loading cartridges into a revolver or other weapon. U.S. Pat. No. 3,722,125 to Switzer discloses a holder that releasably secures a round of cartridges within cartridge bores in a cylindrical housing. A manually rotated member selectively secures or releases the cartridges into the cylinder of the revolver. A positioning mechanism is provided to maintain the holder in either a release position or an engaged position. This locking mechanism is formed of several members and extends externally of the housing.

An improved cartridge loader by the same inventor is disclosed in U.S. Pat. No. 4,202,124. The cartridge loader has a star-shaped latch that selectively engages/releases the cartridges. A semi-automatic rotation device may be utilized to rotate the latch. The rotation device is also manually operable to set the latch from the releasing position to the capturing position by rotating a knob. Again, the mechanism that locks the loader into either a engaging position or a releasing position includes many members and extends outwardly from the loader body.

Another known type of cartridge loader is disclosed in U.S. Pat. No. 5,842,299 to Switzer et al. This patent is primarily directed at providing a cartridge loader for more than the standard five- or six-chambered revolver. However, a portion of the locking system for selectively positioning the holder into engaging or releasing positions is still located externally from the holder's casing.

Each of the aforementioned prior art cartridge loaders have externally extending members that reduce the efficiency of cylinder loading by creating a gap between the cartridge holder and the revolver's cylinders. One problem addressed by the present invention is that the cartridges may fall sideways instead of within the appointed cylinder due to the gap. Another problem addressed in the present invention is that damage or breakage could occur to exposed parts if the loader is dropped or otherwise subjected to force.

The present invention has no external parts to be broken off, and also efficiently loads the cartridges into the revolver.

The present invention contemplates a new and improved loader for a revolver, which is simple in design, effective in use, and overcomes the foregoing difficulties and others while providing better and more advantageous overall results.

SUMMARY OF THE INVENTION

In accordance with the present invention, a new and improved cartridge loader for a revolver is provided. The cartridge loader includes a cylindrical loader body having spaced first and second surfaces, a cylindrical central cavity extending from the first surface into the loader body and a plurality of circumferentially located cartridge bores extending from the second surface into the loader body. A selectively rotatable pintle is received within the central cavity and operates between a closed position, at which cartridges may be temporarily stored, and an open position at which the cartridges may be released. Latching means are carried on the pintle and operable therewith. The latching means include a plurality of cartridge-engaging protrusions, each of which intersect a different one of the cartridge bores when the pintle is in the closed position and do not intersect the cartridge bores when the pintle is in the open position. The cartridge loader includes détente means positioned between the spaced surfaces of the loader body which selectively locate the pintle at the closed or open positions.

In accordance with another aspect of the invention, the détente means comprises a pin assembly including a lock pin and a spring wherein the lock pin is adapted for reciprocal movement in a plane generally perpendicular to the axis of rotation of the pintle; a pin-engaging surface including a first pin groove and a second pin groove wherein the lock pin is resiliently engaged in the first pin groove to locate the closed position of the pintle and resiliently engaged in the second pin groove to locate the open position of the pintle; and, reciprocating means for reciprocating the lock pin, the reciprocal means being positioned intermediate said first and second pin grooves.

In accordance with another aspect of the invention, the pin-engaging surface is formed in the pintle and the reciprocating means is a ball bearing held in a bearing groove formed in the pintle.

In accordance with another aspect of the invention, the pin-engaging surface is formed in the pintle and the reciprocating means is a rise formed in the pintle.

In accordance with another aspect of the invention, the central cavity extends a length less than a distance between the first and second surfaces of the loader body.

In accordance with another aspect of the invention, each of the cartridge bores extends a length less than a distance between the first and second surfaces of the loader body.

One advantage of the present invention is that the revolver can be quickly loaded.

Another advantage of the present invention is the simplicity of design as compared to other prior art loaders.

Another advantage of the present invention is that the détente means is contained within the loader body and is protected from contaminants and debris.

Another advantage of the present invention is the permanent assembly of the associated parts.

Still another advantage of the present invention is that the locking mechanism is internally located to prevent damage to exposed parts.

Yet another advantage of the present invention is that the absence of external projections on the side placed next to the revolver chamber permits more efficient loading of the cartridges.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

DESCRIPTION OF THE PREFERRED EMBODIMENT

Figure 1:
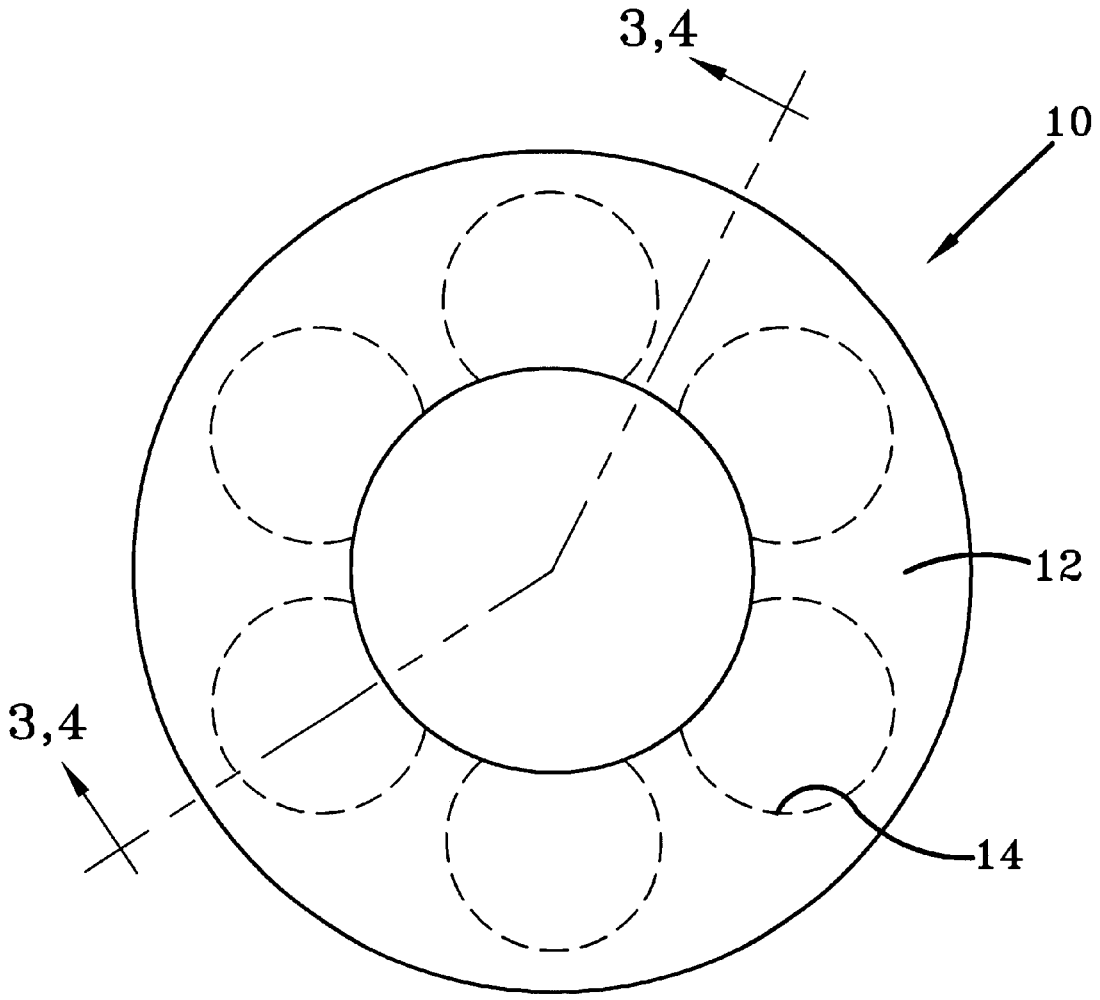
FIG. 1 is a top plan view of one embodiment of a cartridge loader according to the present invention showing the location of a plurality of cartridge bores in dotted lines.

Referring now to the drawings, which are for purposes of illustrating a preferred embodiment of the invention only, and not for purposes of limiting the same, FIG. 1 shows a top view of a new and improved cartridge loader 10, including a loader body 12 with a series of circumferentially positioned cartridge bores 14. In the preferred embodiment, the cartridge bores 14 do not extend entirely through the loader body 12. However, simple modifications could be made to the preferred embodiment to include cartridge bores that extend entirely through the loader body 12. Such modifications are within the scope of the present invention.

Figure 2:
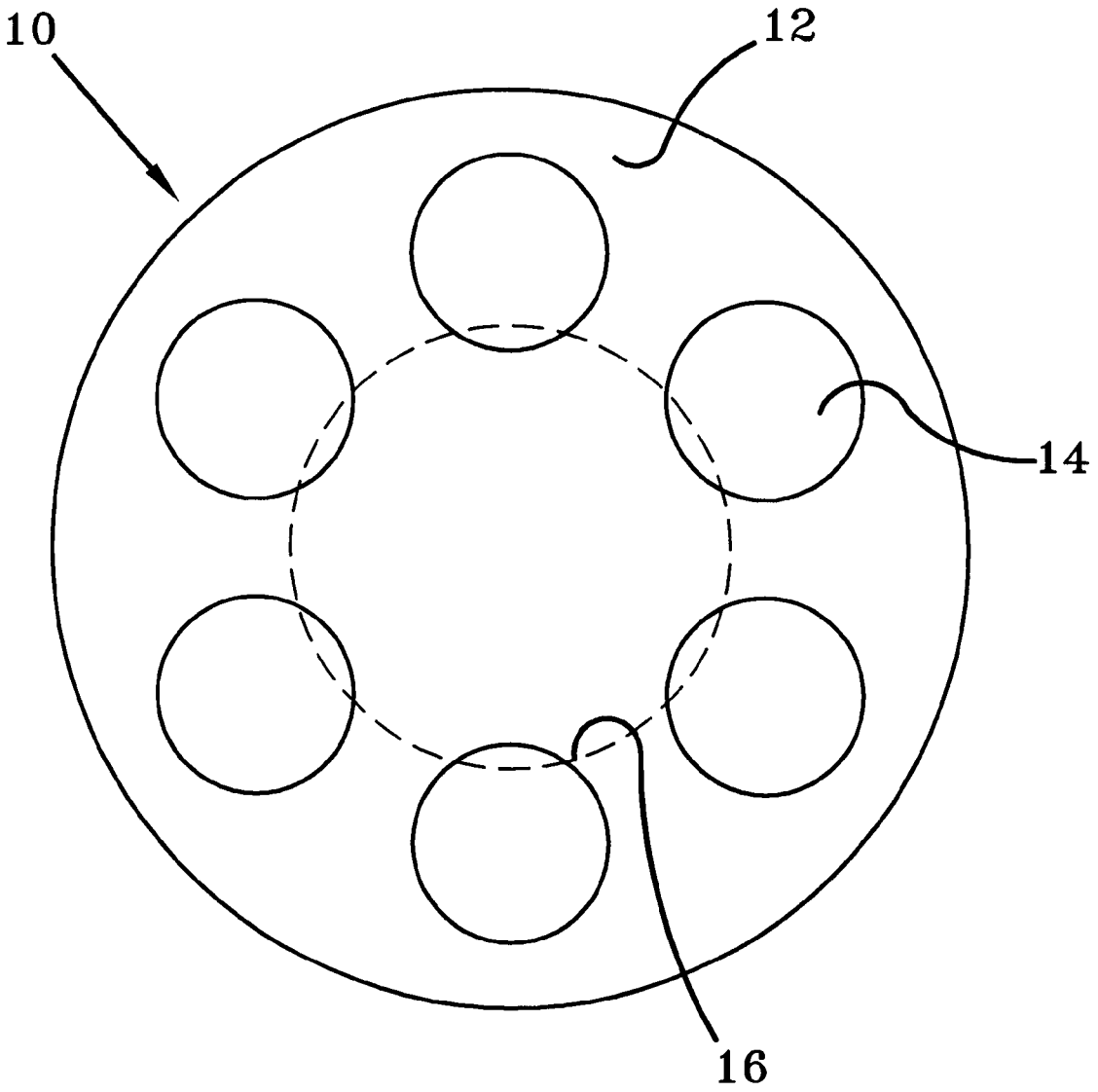
FIG. 2 is a bottom plan view of the embodiment shown in FIG. 1 showing the location of the central cavity in dotted lines.

FIG. 2 shows a bottom view of the embodiment shown in FIG. 1. A central cavity 16 holds a rotatable pintle 30, not shown in this view. In the preferred embodiment the central cavity 16 does not extend entirely through the loader body 12 in order to limit entry points for debris or contaminants. However, it is within the scope of the invention to provide a central cavity that extends entirely through the loader body 12.

Figure 3:
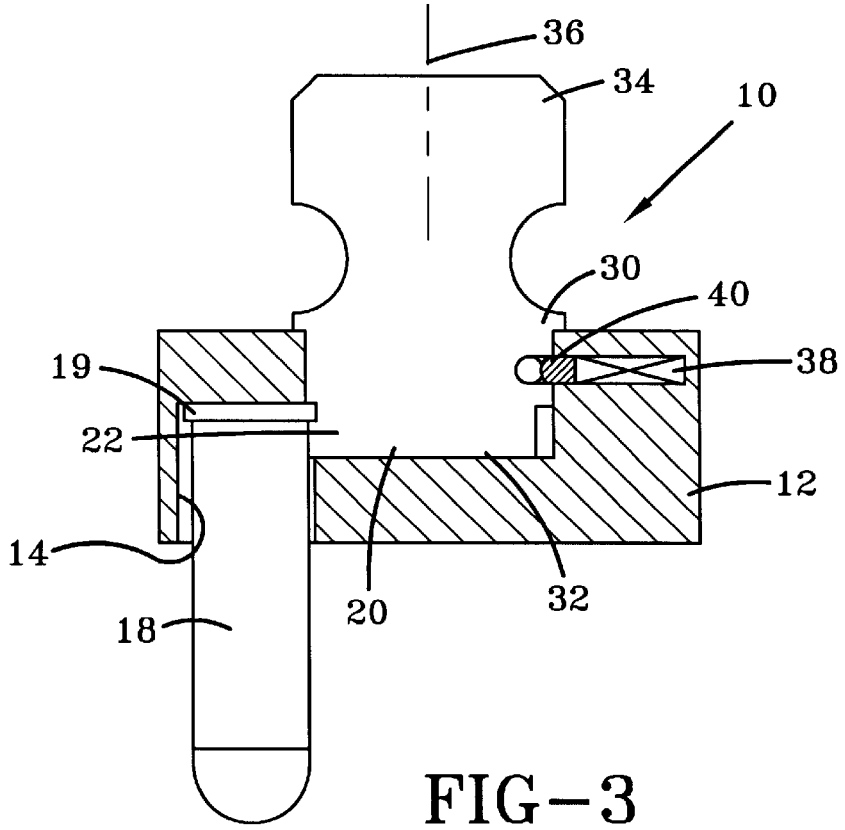
FIG. 3 is a sectional view of the embodiment shown in FIG. 1 cut along the line 3—3 when the pintle is in the closed position.

With reference to FIG. 3, the cartridge loader 10 is shown in the "closed" position as will be explained in further detail below. The loader 10 includes latching means 20 for selectively engaging an associated cartridge 18 when the loader 10 is in the closed position. The latching means 20 includes cartridge-engaging protrusions 22 which intersect the cartridge bores 14 when the loader 10 is in the closed position. For illustrative purposes only, an associated cartridge 18 is shown positioned within a cartridge bore 14. As shown, the cartridge bore 14 is dimensioned to accommodate the larger diameter flanged end of the associated cartridge 18. The cartridge-engaging protrusion 22 extends into the cartridge bore 14 to engage the flange 19 and thereby selectively secure the cartridge 18. In the preferred embodiment, the latching means 20 are located at the end 32 of the pintle 30 that is contained entirely within the loader body 12. Other embodiments anticipated by the inventor include a pintle 30 that extends all the way through the loader body 12.

Figure 4:
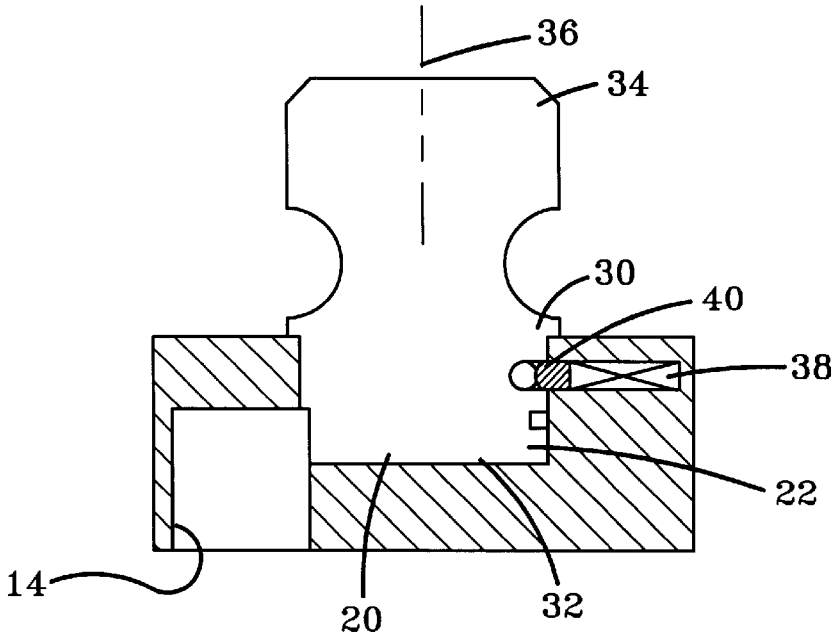
FIG. 4 is a sectional view similar to FIG. 3 cut along the line 4—4 of FIG. 1 when the pintle is in the open position.
Figure 5:
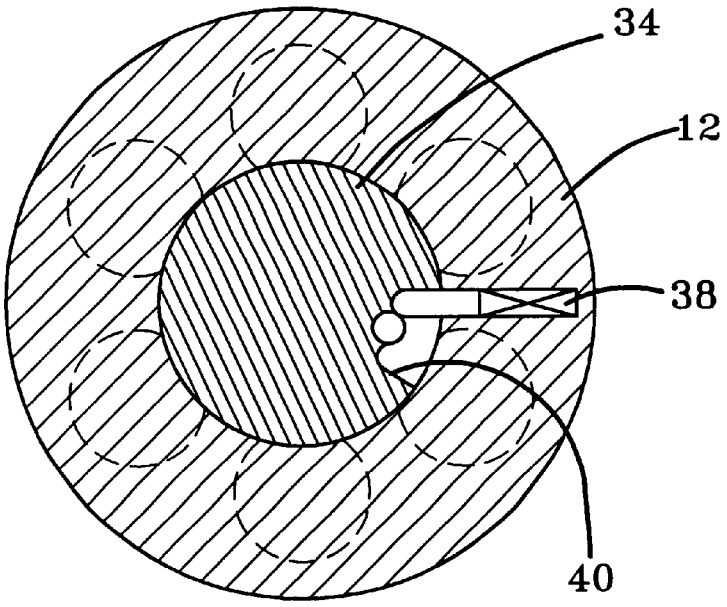
FIG. 5 is a partial sectional view taken directly above the pin assembly of the embodiment shown in FIG. 4.
Figure 6:
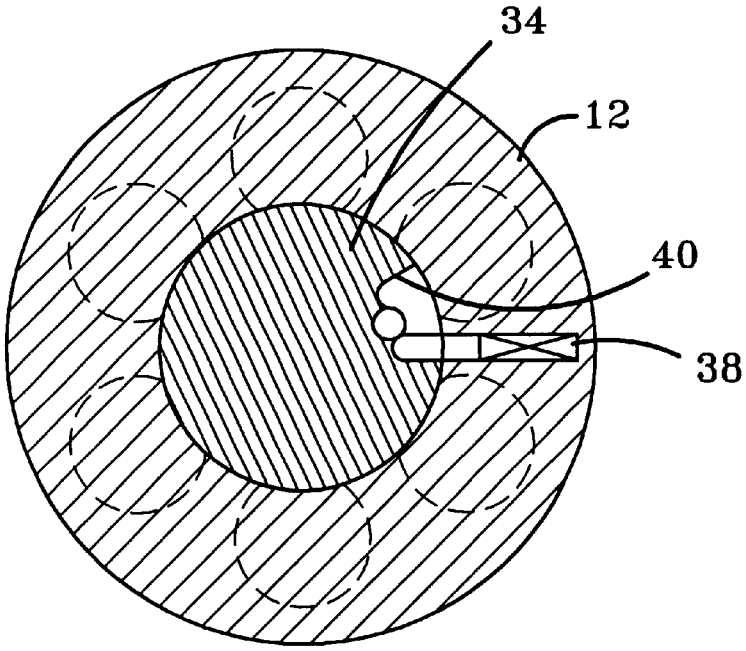
FIG. 6 is a partial sectional view taken directly above the pin assembly of the embodiment shown in FIG. 3.

In FIG. 4, the cartridge loader 10 is shown in the "open" position where the latching means 20 is positioned such that the protrusions 22 do not intersect the cartridge bores 14. In the "open" position, the cartridge 18 is released from the cartridge bore 14 and is therefore not shown in this view. The loader 10 is manipulated into the open position in order for associated cartridges 18 to be positioned therein. Thereafter, the loader 10 is manipulated into the closed position to selectively retain the associated cartridges 18. Manipulation of the loader 18 again into the open position allows the retained cartridges 18 to disengage, as for example into a revolver chamber.

For ease of manufacture and operation, in the preferred embodiment, the latching means 20 is integral with the pintle 30. However, it is within the scope of the invention to have a non-integral latching means 20 carried on the pintle 30 and rotatable therewith.

With reference to FIGS. 3–7, the salient features of one of the preferred embodiment of the present invention will be disclosed. The cartridge loader 10 includes a pintle 30 being rotatable about an axis 36. Latching means 20 is operably associated with the pintle 30. The pintle 30 is disposed in central cavity 16. The pintle 30 may be rotated by manipulation of a knob 34 as is well known in the art. Knob 34 may be integral with pintle 30, as in the preferred embodiment, or may be a separate attachment. The pintle 30 rotates between the "closed" position shown in FIGS. 3 and 5 and the "open" position shown in FIGS. 4 and 6. The extent of rotation is determined by détente means 37 which in the preferred embodiment include a pin assembly 38, a pin-engaging surface 40, and reciprocating means such as ball bearing 41.

Figure 7:
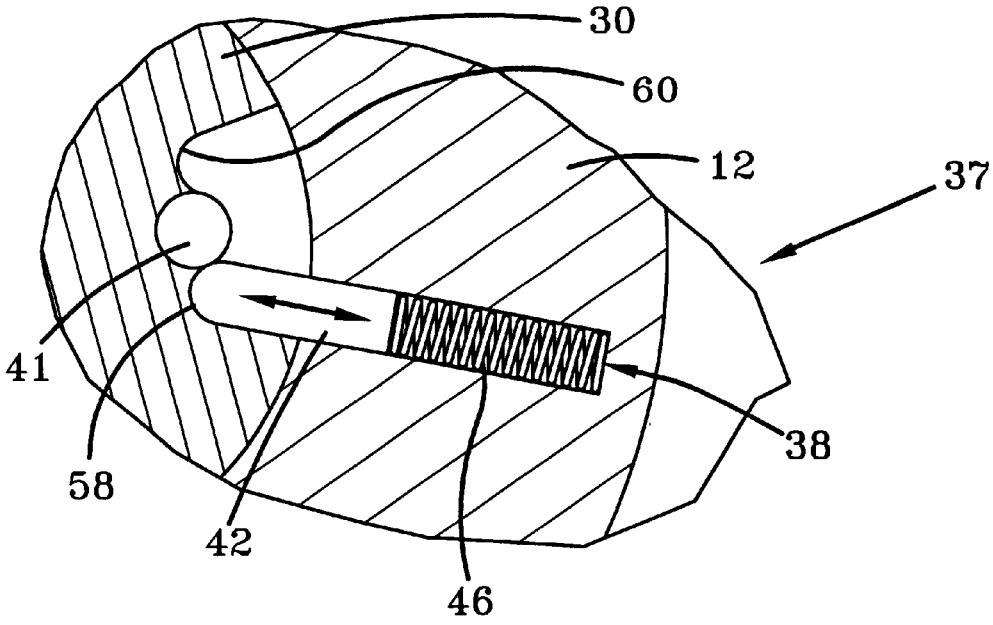
FIG. 7 is an enlarged view of a portion of the view shown in FIG. 6, and, FIG. 7A is a view similar to FIG. 7 of an alternate embodiment of the invention.

With particular reference to FIG. 7, the preferred pin assembly 38 includes a lock pin 42 and a resilient member such as spring 46. The spring 46 and at least a portion of the lock pin 42 may be enclosed in a casing (not shown). The pin assembly 38 is disposed so that the lock pin 42 reciprocates is a direction generally perpendicular to the axis 36 of the central cavity 16. During rotation of the pintle 30, the ball bearing 41 retains its relative position in the loader body 12 and the lock pin 42 reciprocates due to compression and expansion of spring 46. In the preferred embodiment, the loader body 12 may be formed of aluminum or other lightweight material while the ball bearing 41 and the lock pin 42 may be formed of steel or other durable material.

Figure 7A:
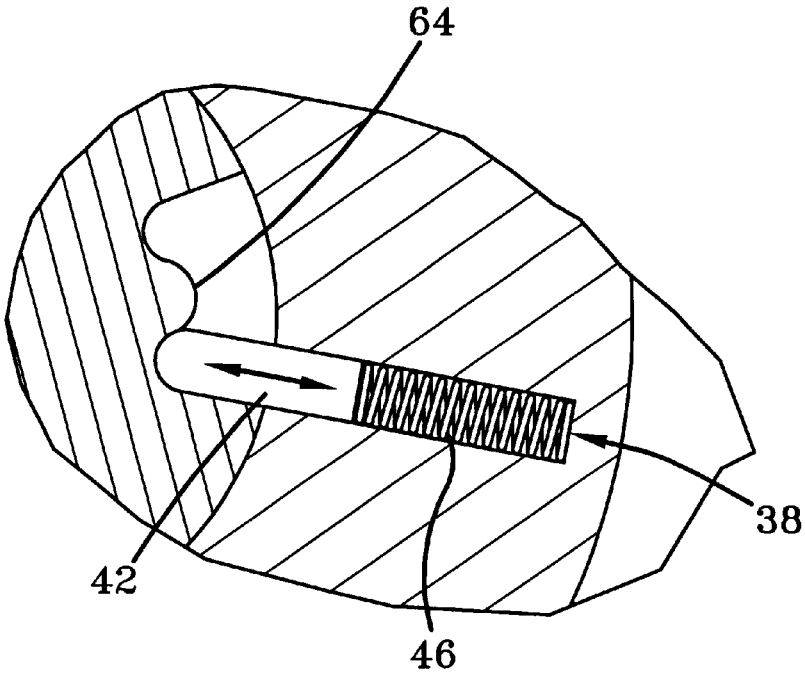

As best shown in FIG. 7, lock pin 42 may be selectively engaged within first pin groove 58 or second pin groove 60 to fix the limits of rotation of pintle 30. Reciprocating means such as ball bearing 41 is located intermediate the pin grooves 58, 60. An alternate reciprocating means could be employed within the scope of the present invention. Although not preferred because of wear characteristics, it is possible to form a rise 64 between the first and second pin grooves 58, 60 by extension of the pintle material as shown in FIG. 7A.

As is apparent from FIG. 7, the détente means 37 also functions to prevent pintle 30 from becoming disengaged from the loader body 12 after the loader 10 has been assembled. At all times, lock pin 42 extends past the wall of the central cavity 16.

Although one embodiment of latching means 20 has been disclosed above, the latching means 20 may differ therefrom without departing from the spirit and scope of the present invention. Additionally, a cartridge loader 10 incorporating other features known in the art or chosen with sound engineering principles, such as rim stops, bore closures, lighting devices and the like are within the scope of the present invention.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

I claim:

1. An improved cartridge loader for a revolver adapted for use with a plurality of associated cartridges comprising:

a cylindrical loader body having spaced first and second surfaces, said loader body defining a generally cylindrical central cavity extending from said first surface into said loader body and a plurality of circumferentially located cartridge bores extending from said second surface into said loader body;

a pintle received within said central cavity, said pintle being selectively rotatable about an axis between a closed position at which associated cartridges are held in temporarily stored relation with said loader and an open position at which temporarily stored cartridges are released therefrom;

latching means for selectively latching said associated cartridges in said temporarily stored relation, said latching means being carried on said pintle and being operably associated therewith, said latching means including a plurality of cartridge-engaging protrusions each of which intersect a different one of said plurality of cartridge bores when said pintle is in said closed position and do not intersect said cartridge bores when said pintle is in said open position; and, détente means positioned between said first and second surfaces of said loader body, said détente means being adapted to selectively locate said pintle at said closed position and said open position.

2. An improved cartridge loader for a revolver adapted for use with a plurality of associated cartridges comprising:

a cylindrical loader body having spaced first and second surfaces, said loader body defining a generally cylindrical central cavity extending from said first surface into said loader body and a plurality of circumferentially located cartridge bores extending from said second surface into said loader body;

a pintle received within said central cavity, said pintle being selectively rotatable about an axis between a closed position at which associated cartridges are held in temporarily stored relation with said loader and an open position at which temporarily stored cartridges are released therefrom;

latching means for selectively latching said associated cartridges in said temporarily stored relation, said latching means being carried on said pintle and being operably associated therewith, said latching means including a plurality of cartridge-engaging protrusions each of which intersect a different one of said plurality of cartridge bores when said pintle is in said closed position and do not intersect said cartridge bores when said pintle is in said open position; and, détente means positioned between said first and second surfaces of said loader body, said détente means being adapted to selectively locate said pintle at said closed position and said open position wherein said détente means comprises:

a pin assembly including a lock pin and a spring, said lock pin being adapted for reciprocal movement in a plane generally perpendicular to said axis;

a pin-engaging surface including a first pin groove and a second pin groove wherein said lock pin is resiliently engaged in said first pin groove to locate said closed position of said pintle and resiliently engaged in said second pin groove to locate said open position of said pintle; and, reciprocating means for reciprocating said lock pin, said reciprocal means being positioned intermediate said first and second pin grooves.

3. The improved cartridge loader of claim 2 wherein said pin-engaging surface is formed in said pintle and said reciprocating means is a ball bearing held in a bearing groove formed in said pintle.

4. The improved cartridge loader of claim 2 wherein said pin-engaging surface is formed in said pintle and said reciprocating means is a rise formed in said pintle.

5. The improved cartridge loader of claim 1 wherein said central cavity extends a length less than a distance between said first and second surfaces of said loader body.

6. The improved cartridge loader of claim 1 wherein each of said cartridge bores extends a length less than a distance between said first and second surfaces of said loader body.

7. The improved cartridge loader of claim 2 wherein said central cavity extends a length less than a distance between said first and second surfaces of said loader body.

8. The improved cartridge loader of claim 2 wherein each of said cartridge bores extends a length less than a distance between said first and second surfaces of said loader body.

* * * * *